United States Patent [19]

Wrightman

[11] Patent Number: 5,020,289

[45] Date of Patent: Jun. 4, 1991

[54] IN LOG JOINT AND MACHINE FOR FORMING LOG JOINT

[76] Inventor: Ronald A. Wrightman, c/o P.O. Box 2169, Bracebridge, Ontario, Canada, K0M 2K0

[21] Appl. No.: 593,304

[22] Filed: Oct. 5, 1990

Related U.S. Application Data

[63] Continuation of Ser. No. 348,137, May 5, 1989, abandoned, which is a continuation of 199, 798, May 27, 1988, abandoned.

[30] Foreign Application Priority Data

Nov. 23, 1987 [CA] Canada ..... 552517

[51] Int. Cl.[5] ..... E04B 1/10

[52] U.S. Cl. ..... 52/233; 52/286; 52/586; 403/292

[58] Field of Search ..... 52/233, 284, 286, 586; 446/85, 106; 403/292, 294, 297

[56] References Cited

U.S. PATENT DOCUMENTS

| | | | |
|---|---|---|---|
| 2,392,551 | 1/1946 | Roe | 52/586 |
| 3,189,950 | 6/1965 | Johnson | 52/233 |
| 3,381,428 | 5/1968 | Sillman | 52/233 |
| 3,440,784 | 4/1969 | Onjukha | 52/233 |
| 3,527,005 | 9/1970 | Slavens | 52/233 |
| 3,969,859 | 7/1976 | Hisey | 52/233 |
| 4,126,977 | 11/1978 | Chisum | 52/233 |
| 4,185,428 | 1/1980 | Boucquey et al. | 52/233 |
| 4,279,108 | 7/1981 | Collister, Jr. | 52/233 |
| 4,599,837 | 7/1986 | Wrightman | 52/233 |

FOREIGN PATENT DOCUMENTS

| | | | |
|---|---|---|---|
| 1373787 | 8/1964 | France | 52/233 |
| 1452263 | 8/1966 | France | 52/233 |
| 129688 | 10/1950 | Sweden | 52/233 |

*Primary Examiner*—Michael Safavi

*Attorney, Agent, or Firm*—Fetherstonhaugh & Co.

[57] ABSTRACT

In a tongue and groove log joint a seal seating channel is formed in the base of the longitudinal groove and a resiliently flexible seal is seated in the seal seating channel. A slot may also be cut in the base to accommodate a reinforcing metal rod. In a butt joint in which a second log underlies the butting logs a seat is formed in the edge of the second log in alignment with the locking slots of the butt joint to receive an end of the locking pin. The seat locks the locking pin against longitudinal movement with respect to the second log. In a wall construction in which the logs of the adjoining walls are connected by an overlapping tenon joint, a first pair of elongated tubular cavities arranged one on each side of a first interface and a second pair of elongated tubular cavities arranged one on each side of a second interface. The tie members are located at each interface and are arranged with one lobe seated in one of the tubular cavities on one side of the interface and the other lobe seated in the tubular cavity on the other side of the interface.

22 Claims, 6 Drawing Sheets

IN LOG JOINT AND MACHINE FOR FORMING LOG JOINT

Figure 1:
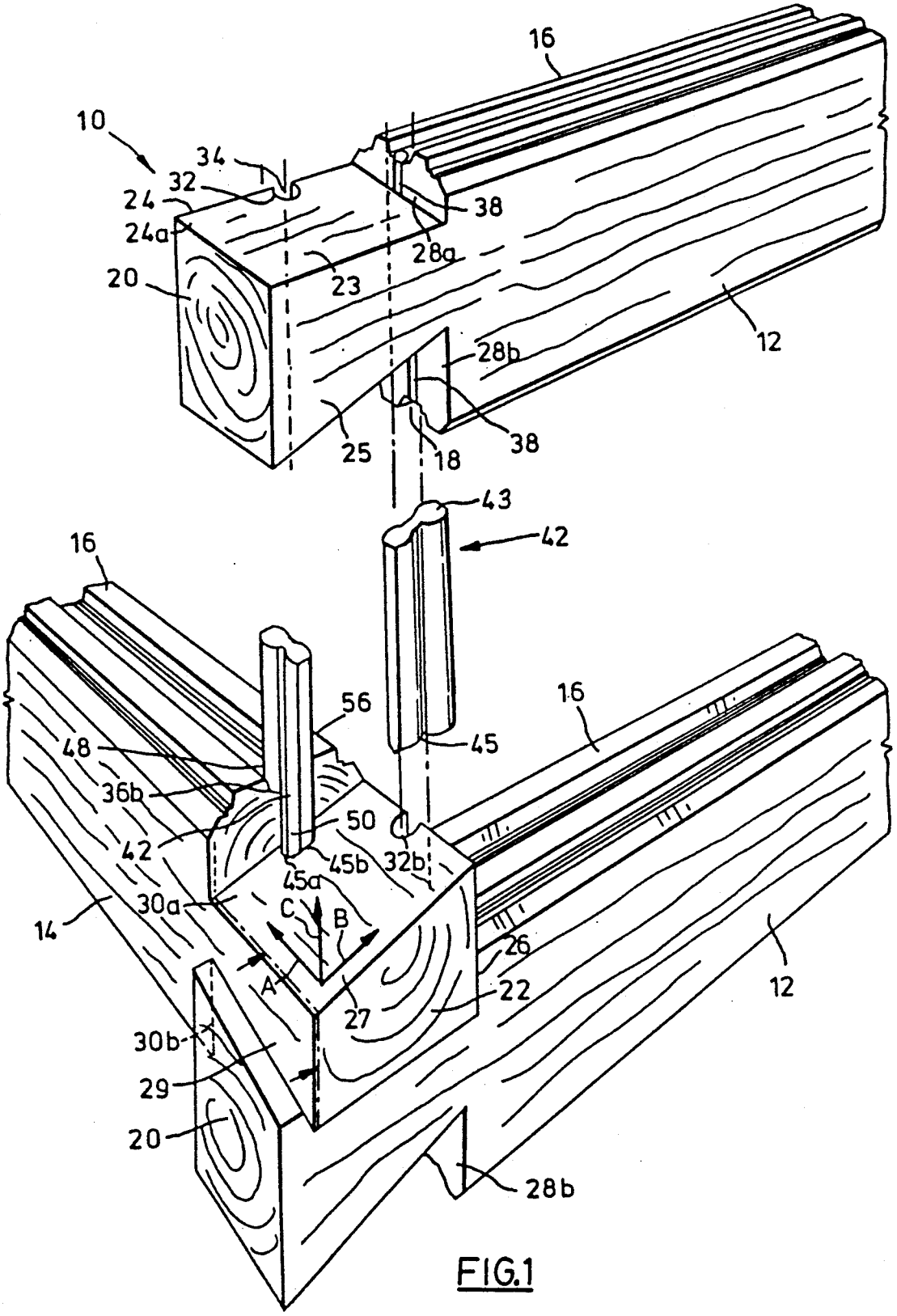

This application is a continuation of application Ser. No. 07/348,137, filed May 5, 1989, now abandoned, which is a continuation of application Ser. No. 07/199,798, filed May 27, 1988.

This invention relates to logs for use in the construction walls for a building or the like and an apparatus for pre-drilling logs.

Buildings of the type which are generally known as "log cabins" have a substantial aesthetic appeal and can be conveniently prefabricated for ease of assembly in use.

Difficulty has, however, long been experienced in attempting to maintain airtight joints between the logs. It is difficult to machine a log to tight tolerances and consequently, it is difficult to obtain a tight seal at the various interfaces formed between adjoining logs. In addition, with age, logs tend to shrink and this shrinkage causes separation at the various interfaces and this can result in difficulties in attempting to maintain a seal at the critical interfaces.

In order to obtain a seal at the interface between logs it is customary to caulk the joints. Again, the caulking tends to loosen as the logs shrink with the result that regular periodic replacement of caulking is required in order to maintain a required seal.

The difficulties which have been encountered in attempting to obtain an effective seal at an interface between logs are compounded when attempting to obtain such a seal at the corners of a building in which the logs are shaped to provide tenons such as those used to provide a dovetail corner joint or a lap corner joint. In these joints, there are two interfaces arranged at right angles with respect to one another. Generally, the mechanical locking arrangement provided by these interlocking tenons has been considered to provide a more effective seal than that which is normally established between the side edges of the logs and consequently, it is generally considered that conventional caulking is all that is required in this area.

Difficulty has also been experienced in attempting to obtain an effective seal between logs which are connected in an edge to edge relationship by means of a tongue and groove joint. The tongue and groove joint is commonly used along the edge of a long log. Because of uneven shrinkage during the aging of a log, there is a danger of a portion of the tongue and groove joint becoming unseated and as a result, it is difficult to maintain an effective seal at the joint. In addition, when a double tongue and groove profile is used along the edges of a log, the channel which is formed between the tongues can act as a reservoir for retaining any water which might seep into the joint and if this water is subsequently frozen, the expansion caused by the formation of the ice can force the logs apart at the joint and thereby further reduce the effectiveness of the seal formed between the joints.

A further difficulty which is experienced in log cabin construction is that the buildings do not provide the same degree of security as is available from a break belting because it is possible to gain entry to the building simply by sawing through the logs.

In addition, difficulty has been experienced in attempting to accurately pre-drill large logs to facilitate the mounting of locking keys. Various different standard sizes of logs are used in log cabin construction and no simple and effective form of drilling machine is available for the purposes of accurately drilling logs at any one of a number of predetermined drilling positions.

SUMMARY OF THE INVENTION

According to one aspect of the present invention, there is provided a machine for trimming and drilling logs to form walking passageways comprising a drilling platform for supporting a log thereon during trimming and drilling, stop means extending along a first edge of said drilling platform in a first datum plane, clamp means mounted for movement toward and away from stop means for releasably clamping a log against said stop means, a notch extending inwardly of said platforms from said one edge along which a saw blade may pass to trim a log which is clamped on said drilling platform to provide a second datum plane along an end face of the log, an inner set of drilling slots comprising right an left hand first elongated drill slots symetrically arranged to the right and left of said second datum plane respectively and extending along a first side of said platform adjacent said stop means, right and left second elongated drill slots symetrically arranged to the right and left of said second datum plane and extending at a first angle with respect to said first and second datum plane, right and left third elongated drill slots symetrically arranged to the right and left of said second datum plane and extending at a second angle with respect to said first and second datum plane, an outer set of drilling slots comprising right and left hand first elongated drill slots symetrically arranged to the right and left of said second datum plane respectively and extending along a first side of said platform adjacent said stop means, right and left second elongated drill slots symetrically arranged to the right and left of said second datum plane and extending at a first angle with respect to said first and second datum plane, right and left third elongated drill slots symetrically arranged to the right and left of said second datum plane and extending at a second angle with respect to said first and second datum plane, a base underlying said drill platform, right and left undercarriages slidably mounted on said base and arranged to the right and left respectively of said second datum plane, right and left first, second and third slide members slidably mounted on said right and left undercarriages respectively for movement in a direction parallel to said first, second and third slots respectively, first, second and third drill frames mounted on and extending upwardly from said first, second and third slide members respectively, first, second and third drilling machines slidably mounted on said first, second and third drill frames respectively for movement toward and away from said platform, first, second and third drive means for moving said first, second and third slide members respectively to locate said first, second and third drilling machines in any one of a number of drilling stations located at spaced intervals along each drilling slot, right and left undercarriage drive means for driving the right and left undercarriages respectively, relative to the frame to align the first and second drill means with the first, second and third slots of the inner or outer sets of drilling slots, a fourth slide member slidably mounted on said base for movement along a slipway which extends along a path which is aligned with and underlies said first notch, a fourth drill frame mounted on and extending upwardly from said fourth slide member, a fourth drilling machine mounted on said fourth support frame for movement toward and away from said platform, said fourth drilling machine having a drilling access, fourth drive means for moving said fourth slide member in the direction of the extent of the first notch, offsetting means arranged to engage said first support frame to laterally offset said drilling machine to the right or left of said datum plane so that the drilling access of said fourth drilling machine may be located adjacent the second datum plane on the right or the left side thereof as required in use.

According to a further aspect of the present invention there is provided a log for use in a structure in which a plurality of logs are connected by tongue and groove joints, said log comprising an elongated body having oppositely disposed longitudinal edges, one formed with a tongue profile and one formed with a complimentary groove profile, said groove having a base face extending longitudinally thereof, and a seal seating channel formed in said base and extending longitudinally thereof.

According to yet another aspect of the present invention, there is provided in a log of the type having first and second side edges formed with a double tongue and groove profile respectively and wherein the tongues are spaced from one another by a channel and a ridge is formed between the grooves, the improvement of a seal seating groove formed in the base of said channel and extending longitudinally thereof.

According to a still further aspect of the present invention, there is provided in a wall of a log structure in which a plurality of logs are interconnected by double tongue and groove joints formed at an interface between abutting edges of adjacent logs and wherein the tongues are spaced from one another by a channel and a ridge is formed between the grooves, the improvement of a seal seating groove formed in the base of said channel and extending longitudinally thereof, seal means in the form of an elongated length of compressed material seated in said groove and compressed between said ridge and the base of said channel to form a seal at said interface along the length of said log.

According to a still further aspect of the present invention, there is provided in a wall assembly formed from logs in which a pair of first logs are arranged in an end to end relationship to form a but joint therebetween and in which a second log is arranged in an edge to edge relationship with the first logs and bridges the but joint and wherein locking slots are formed in each abutting end of said first log to receive a locking tie which serves to lock the butting ends, the improvement of a seat formed in the edge of the second log in alignment with the locking slots to receive an end of a locking pin, said seat being adapted to cooperate with the end of the locking pin to lock the locking pin against longitudinally movement with respect to the second log.

According to yet another aspect of the present invention, there is provided in a wall construction for a building wherein adjoining walls are made from logs and wherein the ends of logs of the adjoining walls are connected by an overlapping tenon joint, a structure for sealing the first and second vertically extending interfaces between the side faces of each tenon and the end face of the log of the other wall which it faces, comprising a first pair of elongated tubular cavities in the logs, one on each side of said first interface, a second pair of elongated tubular cavities in the logs, one on each side of said second interface, the cavities of each pair opening into one another along their respective interfaces and increasing in cross-sectional area in a direction away from the their respective interfaces, a plurality of tie members each comprising a pair of elongated lobes which are connected to one another by a bridging section, one of said rigid tie members being located at each interface and arranged with one of its lobes seated in one of the tubular cavities on one side of the interface and the other of its lobes seated in the tubular cavities on the other side of the interface.

According to a still further aspect of the present invention, there is provided a machine for trimming and drilling logs to form locking passages therein comprising a drilling platform for supporting a log thereon during trimming and drilling, stop means extending along a first edge of said drilling platform in a first datum plane, clamp means mounted for movement toward and away from said stop means for releaseably clamping a log against said stop means, a notch extending inwardly of said platform from said one edge along which a sawblade may pass to trim a log which is clamped on said table to provide a second datum plane along an end face of a log, an inner set of drilling slots comprising right and left first elongated drill slot symetrically arranged to the right and left of said second datum plane respectively and extending along a first side of the platform adjacent said stop means, right and left second elongated drill slots symetrically arranged to the right and left of said second datum plane and extending at a first angle with respect to said first and second datum planes, right and left third elongated drill slots symetrically arranged to the right and left of said second datum plane and extending at a second angle with respect to said first and second datum planes, an outer set of drilling slots comprising right and left fourth drilling slots arranged to the right and left of said second datum plane and being laterally spaced from and aligned with said second slots, right and left fifth drill slots symetrically arranged to the right and left of said second datum plane and laterally spaced from and extending parallel to said second slots at a greater distance from said second datum plane, right and left sixth drill slots symetrically arranged to the right and left of said second datum plane and laterally spaced from and extending parallel to said third slots and spaced a greater distance from said second datum plane a base underlying said drilling platform, right and left undercarriages slidably mounted on said base and arranged to the right and left respectively of said second datum plane, right and left first, second and third slide members slidably mounted on said right and left undercarriages respectively for movement in a direction parallel to said first, second and third drilling slots respectively, first, second and third drill frames mounted on and extending upwardly from said first, second and third slide members respective first, second and third drilling machines slidably mounted on said first, second and third drill frames, respectively for movement toward and away from said drilling platform, first, second and third drive means for moving said first, second and third slide members respectively to locate said first, second and third drilling machines in any one of a number of drilling stations located along each drilling slot, right and left undercarriage drive means for driving the right and left undercarriages respectively, relative to the frame to align the first and second drilling means with the inner or outer set of drilling slots, a fourth slide member slidably mounted on said base for movement along a path which is aligned with and underlies said first notch, a fourth drill frame mounted on said fourth slide member and extending upwardly therefrom, a fourth drilling machine slidably mounted on said fourth drilling frame for movement toward and away from said drilling platform, said fourth drilling machine having a drilling access, offsetting means arranged to engage said first support frame to laterally offset said fourth drilling machine to the right or left of said second datum plane so that its drilling access is located adjacent to the second datum plane on the right or left side thereof as required.

Figure 2:
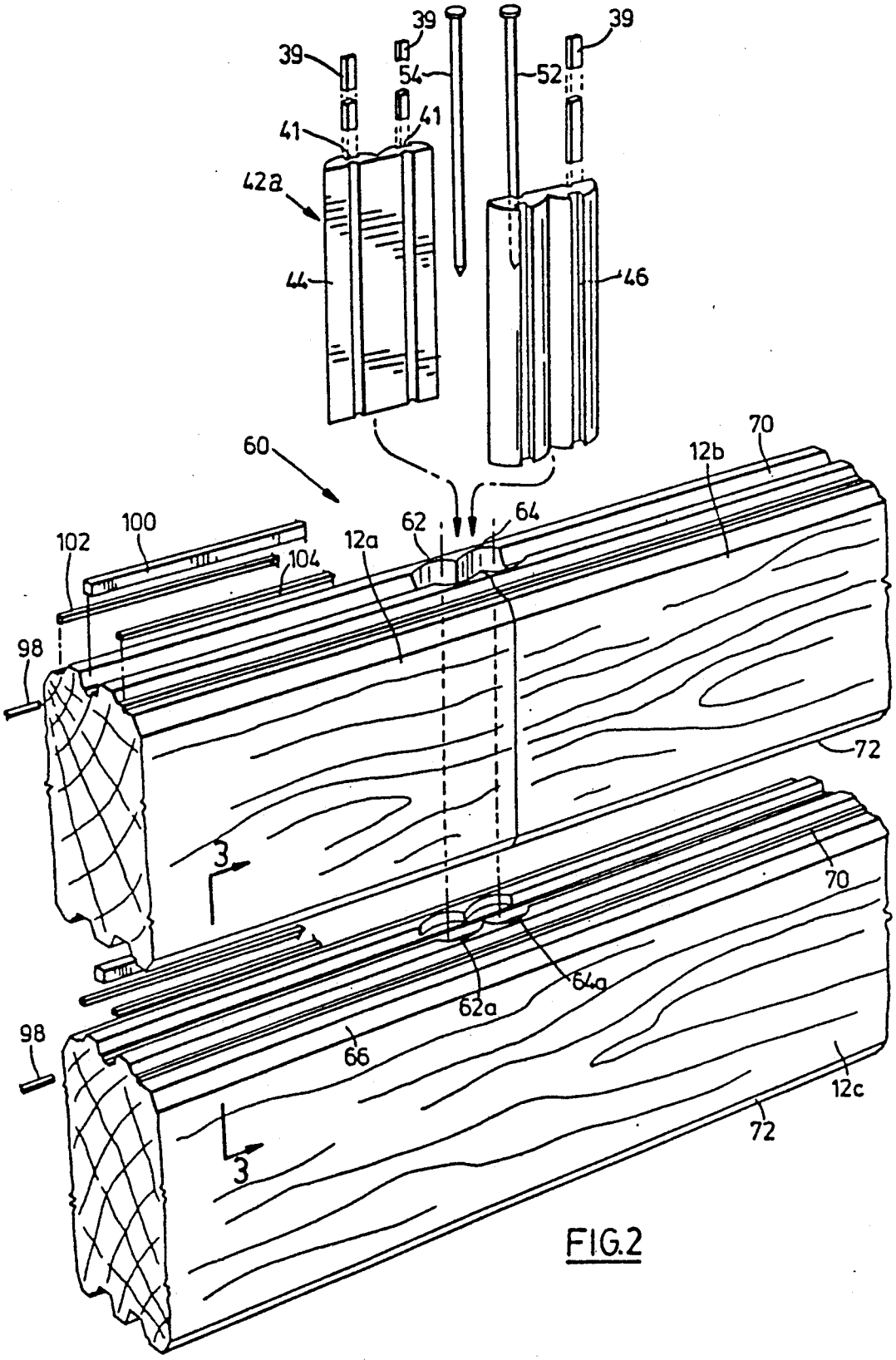
Figure 3:
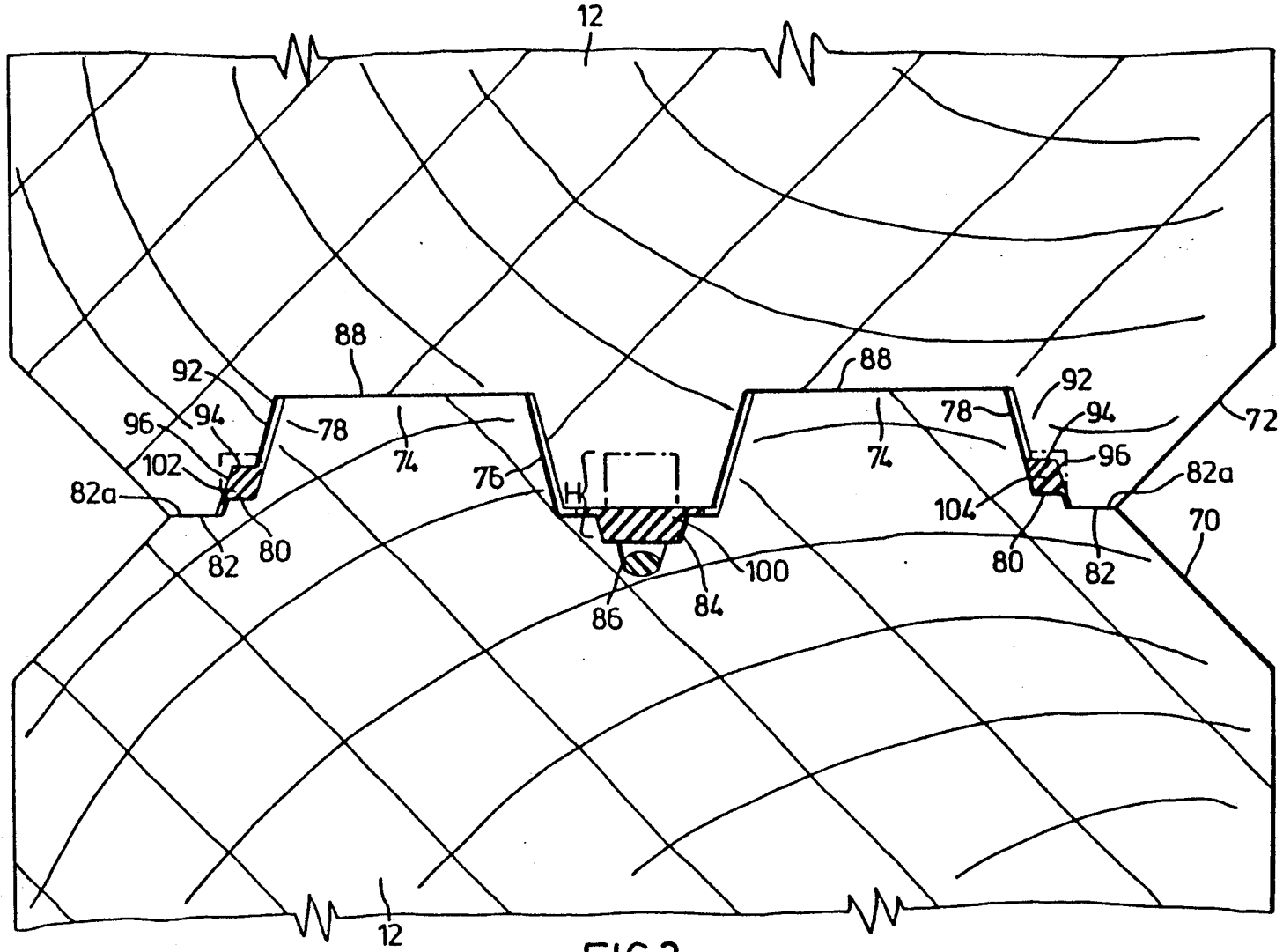

The invention will be more clearly understood after reference to the following detailed specification read in conjunction with the drawings wherein;

FIG. 1 is an exploded view of a corner formed between adjoining walls of a log wall construction according to an embodiment of the present invention, FIG. 2 is an exploded view of a butt joint formed according to an embodiment of the present invention, FIG. 3 is a sectional view taken along the line 3—3 of FIG. 2 illustrating the assembled joint.

Figure 4:
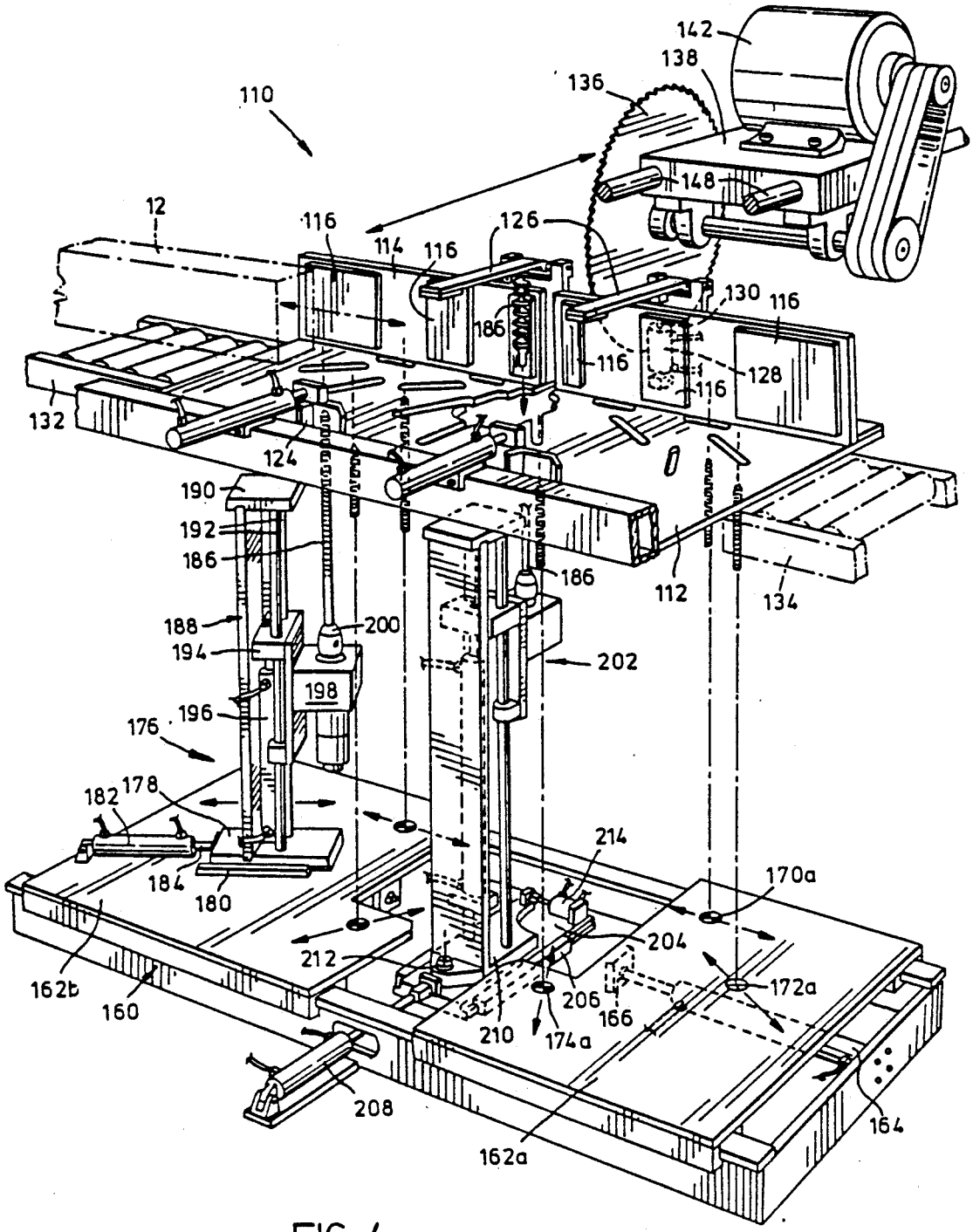
Figure 5:
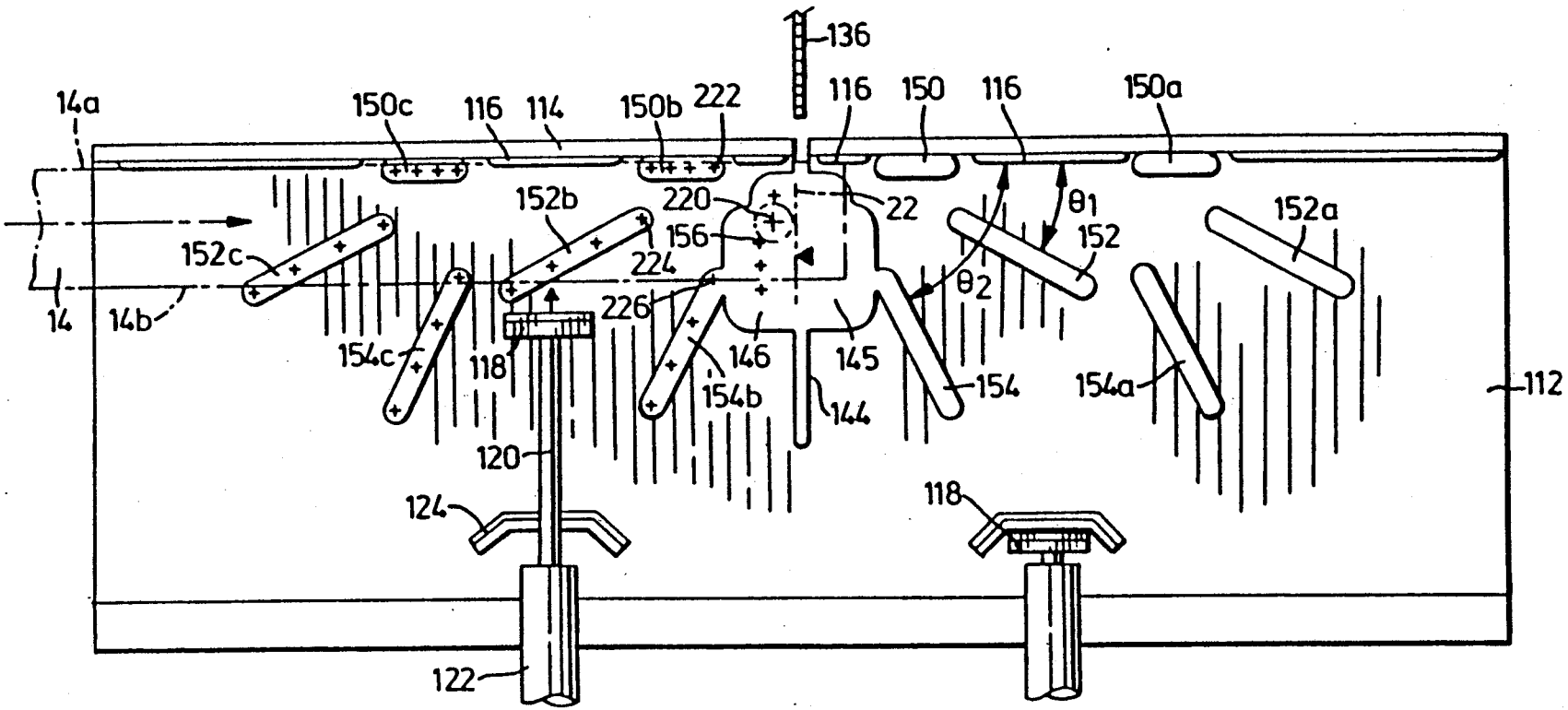
Figure 6:
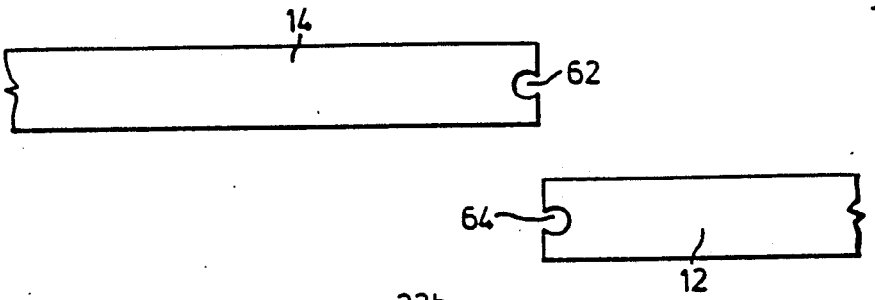
Figure 7:
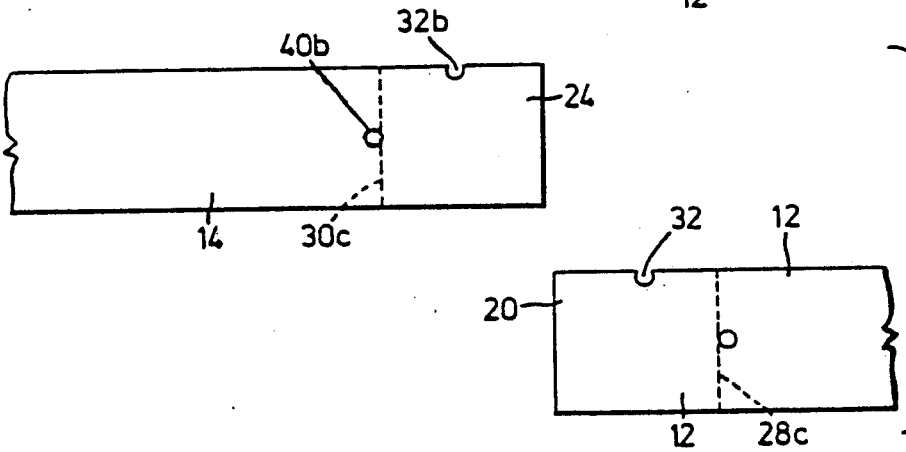
Figure 8:
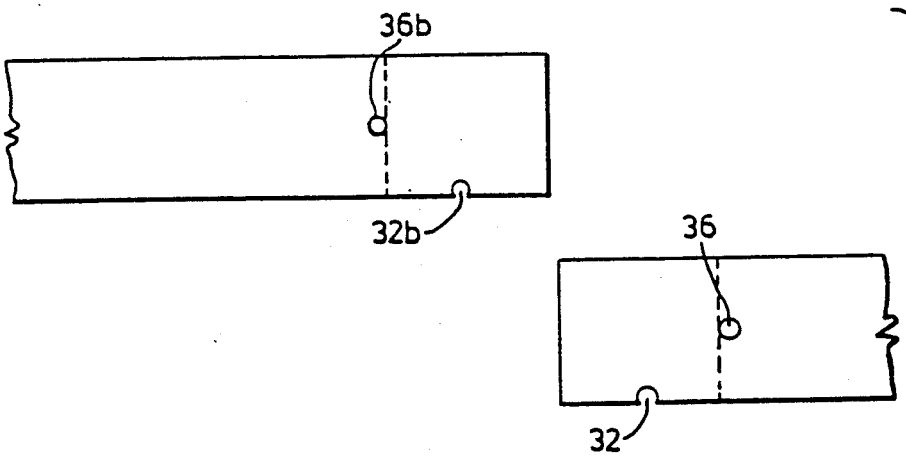
Figure 9:
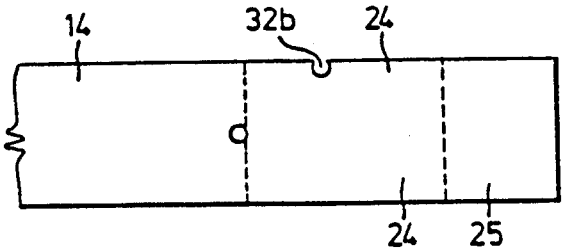
Figure 10:
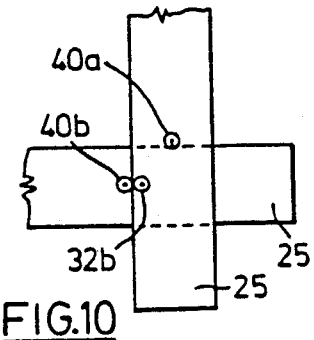

FIG. 4 is a pictorial front view of a machine for drilling logs according to an embodiment of the present invention, FIG. 5 is a plan view of the log supporting platform of FIG. 4, FIG. 6 is a plan view showing logs drilled to provide the butt joint of FIG. 2, FIG. 7 is a plan view of logs drilled to provide the overlapping tenon joint of FIG. 1, FIG. 8 is a plan view of logs drilled to form a corner of the opposite hand to that illustrated in FIG. 7, FIG. 9 is a plan view of a log drilled to provide a lap joint of the type illustrated in FIG. 10, FIG. 10 is a plan view illustrating a lap joint.

With reference to FIG. 1 of the drawings, the reference numeral 10 refers generally to a corner joint construction for adjoining walls according to an embodiment of the present invention. The corner joint 10 is formed from logs 12 and 14. Typical logs may measure 12" in height and may measure 6", 8", 10" or 12" in thickness. The logs 12 and 14 are each formed with a double-tongue edge 16 and a double-groove edge 18 which cooperate with one another to provide a tongue and groove connection. Logs 12 and 14 are formed with tenons 20 and 22 respectively which are cut and shaped to provide a dove-tailed joint of the type described in my prior U.S. Pat. No. 4,599,837 dated July 19, 1986. The tenons 20 each have an inner side face 24 and the tenons 22 each have an inner side face 26. The logs 12 each have a vertically extending end face which includes an upper portion 28*a* and a lower portion 28*b*. The logs 14 each have a vertically extending end face which includes an upper portion 30*a* and a lower portion 30*b*. The tenon 20 has an upper face 23 which is downwardly inclined from the front face 24 to the back face 25. The tenon 26 has an upper face 27 which is downwardly inclined from the front face 26 to the back face 29. A locking slot in the form of an elongated tubular cavity 32 extends vertically through the tenon 20 and has a passageway 34 opening laterally therefrom. A locking slot in the form of an elongated tubular cavity 36 is formed in the end portion of the main body of the log 12 and extends vertically therethrough. The cavity 36 has a passageway 38 formed along one edge thereof. The passageway 38 is exposed at the vertically extending end faces 28*a* and 28*b*. Similar locking slots or cavities 32*b* and 36*b* are formed in the logs 14. The maximum width of the locking slots or cavities 32, 36, 32*b* and 36*b* is greater than the width of their perspective passageways 34 and 38 such that the locking slots or cavities are undercut with respect to the face of the log through which their respective passageways 34 and 38 open.

A one-piece spline 42 is used as a tie member to connect the interlocking tenons to one another. Each spline 42 has a pair of lobes 48 and 50 which are integrally connected to one another and provide a cross-sectional configuration which has the general form of a figure '8'. Each spline 42 has an upper end 43 and a lower end 45. The upper end 43 is inclined at an angle which is equal to the angle of the upper faces 23 and 27 of the tenons so that they will lie flush with the upper face of their associated tenon in use. The lower end 45 of each spline is V-shaped and has end faces 45*a* and 45*b* which are inclined so as to butt against the upper face 23 or 27 which underlies the spline in use.

When assembling the corner, the tenon 22 of a log 14 is positioned on the tenon 20 as shown in FIG. 1. The tenons are tightly nested so that the inner side face 26 of the tenon 22 is located in a face-to-face relationship with respect to the vertically extending end face 28*b* and the end face 30*b* bears against the side face 24 of the underlying tenon 20.

In use the lobe 48 of a spline 42 is driven into the tubular cavity 32*b* until the upper end 56 of the spline 42 is flush with the upper face 27 of the tenon and its lower end bears against the upper face 23 of the underlying tenon 20. In this position the lobe 50 will extend into the passage 36 in the underlying log to secure the logs to one another at the interface formed therebetween. A further spline 42 is mounted in the log 14 with its lobe 50 located in the tubular cavity 36*b* and its lower end bears against the upper face 27. Thereafter, the next log 12 is positioned so that the cavity 36 receives the lobe 50 of one of the spline 42 which projects from the side face 26 of the underlying tenon 22 and the other cavity 34 receives the lobe 48 of the other spline which projects from the end face 30*a*. The lobes 48 and 50 of the splines are shaped and proportioned to draw the logs together along the interface formed between the abutting side face of the tenon and end face of the other log.

This assembly procedure is repeated until the construction of the corner is complete.

Butt Joint

With reference to FIG. 2 of the drawings, a butt joint similar to the type illustrated in my prior U.S. Pat. No. 4,599,837, is generally identified by the reference numeral 60. The butt joint 60 is formed between the abutting ends of logs 12*a* and 12*b* which are located directly above a further log 12*c*. A tubular cavity 62 is formed in the end of the log 12*a* and a tubular cavity 64 is formed in the end of the log 12*b*. Circular recesses 62*a* and 64*a* are formed in the upper edge 66 of the underlying log 12*c* and cooperate with one another to form a seat for the lower ends of the locking pin spline sections 44 and 46". Because of these circular recesses 62*a* and 64*a*, the lower ends of the spline section 44 and 46 are flat and do not have the tongue-shaped profile of the type described in my prior U.S. Pat. No. 4,599,837. Because the lower ends of the section 44 and 46 will be seated in the seat formed by the recesses 62*a* and 64*a* in use, they will serve to retain the logs 12*a* and 12*b* with respect to the underlying log 12*c* against longitudinal relative movement and against lateral movement. Thus, it will be seen that this form of seating of the spline 42*a* serves to more securely retain the wall forming logs. In addition, because it is not necessary to shape the lower ends of the section 44 and 46 of the spline to provide a tongue, the lower ends of the splines 44 and 46 are not weakened. To seal the spline 42*a* in the tubular cavities or locking slots 62 and 64 the outer face of each spline is formed with a longitudinally extending groove 41 in which a compressible sealing member 39 is fitted so as to be compressed between the spline and the walls of the cavities 62, 64. As described in U.S. Pat. No. 4,599,837, the wedging spikes 52 and 54 are driven into the passages formed between the oppositely disposed side faces of the spline sections of the locking pin to expand the spline sections to provide an interference fit within the cavity 62,64 such that the locking pin connects the abutting ends of the logs 12*a* and 12*b*.

Tongue and Groove Seal

As shown in FIGS. 2 and 3 of the drawings, each log 12 has an upper edge 70 and a lower edge 72. A pair of tongues 74 are formed along the upper edge 72 and have a channel 76 formed therebetween. The tongues 74 also have outer side faces 78 each formed with a caulking shoulder 80. A lateral support shoulder 82 extends outwardly from each caulking shoulder 80. A seal seating channel 84 is formed in the base of the channel 76 and extends longitudinally thereof. A further groove 86 is formed in the base of the seal seating channel 84 and extends longitudinally thereof.

A pair of grooves 88 are formed in the lower edge 72 of the overlying log 12. The grooves 88 are spaced from one another by a longitudinally extending ridge 90. The grooves 88 have outer side walls 92 each formed with caulking shoulders 94 which are arranged to cooperate with the caulking shoulders 80 of the underlying log to provide caulking cavities 96 therebetween.

In use, a rod 98 of high calibre steel or the like is seated in each groove 86 in a close-fitting relationship therewith. A resilient sealing member 100 which is in the form of a length of an asphalt impregnated foamed plastics material which is watertight when subjected to 50% compression, is seated in the seal seating channel 84 and extends longitudinally thereof. In the relaxed configuration which is shown in broken lines in FIG. 3, the sealing member 100 has a height H which is at least three times greater than its compressed height so that it will be subjected to a 75% compression and will therefore provide a watertight seal.

Caulking members 102 and 104 are also formed from elongated lengths of foamed plastics material. The caulking members 102 and 104 are, however, preferably formed from a higher density foamed plastics material. The relaxed height of the caulking members 102 and 104 is preferably about 25% greater than the compressed height in use.

As shown in FIG. 3 of the drawings, the caulking strips 102 and 104 are located in the caulking cavities 96.

When the tongue and groove joint is assembled as illustrated in FIG. 3 of the drawings, the upper faces of the tongues 74 and the bottoms of the grooves 88 will bear against one another while the faces of the ridge 90 will be spaced a short distance from the faces of the channel 76. As a result, when the sealing member 100 is compressed, portions thereof will "flash" into the gap formed between the ridge 90 and channel 76 and the seal member 84 will be compressed into the groove 86. As a result, a very good seal is achieved along the base of the channel 76. Similarly, the lateral support shoulders 82 will come in contact with the lateral support shoulders 82*a* and the caulking members 94 and 96 will "flash" into the spaces formed between the outer side walls 78 of the tongues and the outer side walls 92 of the grooves.

It will be apparent that when the logs shrink or warp with age, the sealing members 100 and the caulking members 102 and 104 can and will expand or contract as required in order to maintain an effective seal at the interface formed between the logs.

The metal rods 98 which extend longitudinally of the logs serve to provide a security network which will prevent cutting of the logs by means of a woodsaw such as a chainsaw.

Machine for Trimming and Drilling Logs

The machine for use in the trimming and drilling of logs is illustrated in FIGS. 4 and 5 of the drawings to which reference is now made. The machine is generally identified by the reference numeral 110. The machine 110 has a drilling platform 112. A wall 114 extends upwardly along one edge of the platform 112 and has pads 116 of a plastic material of a low coefficient of friction mounted thereon. The pads 116 serve as stop means against which one side of a log 12 will bear during trimming and drilling. Clamping members 118 are mounted on the shafts 120 of pneumatics cylinders 122 for movement toward and away from the wall 114. Shielding brackets 124 extend upwardly from the platform 112 and serve to shield the clamping means 118 when in the retracted position so that an incoming log 12 will not be driven against the retracted clamp member 118. Hold down arms 126 are pivotally mounted above the platform 112. A pneumatic cylinder 128 is connected to the connecting rod 130 and is operable to raise and lower the hold down arms 126 as required.

Roller conveyors 132 and 134 are provided for supporting and guiding the logs 12 into an operable position on the platform 112.

A circular saw 136 is mounted on a carriage 138 which is slidably mounted on a pair of guide rods 140 for movement toward and away from the platform 112 and is used for the purposes of trimming the ends of the logs to provide a datum face from which subsequent drilling of the log is accurately positioned.

The saw 136 is powered by an electric motor 142.

As shown in FIG. 5 of the drawings, a plurality of drilling slots are formed in the platform 112.

A notch 144 extends inwardly from the first side edge of the platform 112 and is aligned with the circular saw 136. The notch 144 has an enlarged opening 146 which serves to accommodate the drill which is used for the purposes of drilling tubular cavities in the butt joint ends of logs as will be described hereinafter.

The drilling slots are symetrical about the centre line 145 of the notch 144. The drilling slots include right and left hand inner and outer sets of drillings slots. The right hand inner set of drilling slots will now be described with reference to FIG. 5. The right hand inner set of drilling slots include a first elongated drilling slot 150 which extends along a first side edge of the platform adjacent the stop means 116. It will be noted that the drilling slot 150 extends beyond the inner face of the pads 116. This serves to ensure that when the drill passes through the slot 150 the cavity which is formed thereby will have a passageway opening laterally through the side face of the log. A second elongated drilling slot 152 and a third elongated drilling slot 154 serve to complete the right hand inner set of drilling slots. The slots 152 and 154 are angularly inclined to extend at an angle $\theta_1$, which measures 26° 34[1] and $\theta_2$ which measures 54° 26[1] with respect to the datum face.

The outer right hand drilling slots include elongated drilling slots 150*a*, 152*a* and 154*a*. The left hand inner set of drilling slots includes slots 150*b*, 152*b* and 154*b*. The outer left hand set of drilling slots includes slots 150*c*, 152*c* and 154*c*. Within each slot, there are four drilling stations, the centres of which are identified on the left hand set of slots in FIG. 5. The centre line of each drilling station is identified by a "+". Similar centres are provided in each of the slots of the right hand sets. Within the enlarged opening 146, the centres of five drilling stations are again indicated by a "+", one of which is identified by the reference numeral 156. Similar drilling stations are provided on the opposite side of the centre line 145.

Referring once more to FIG. 4 of the drawings, the reference numeral 160 refers generally to a base which underlies the drilling platform. Right and left hand undercarriages 162*a* and 162*b* are slidably mounted on the base 160. An extensible pneumatic cylinder 164 has one end secured with respect to the base 160 and its other end secured to a bracket 166 which extends downwardly from the platform 162*a*. By expanding and contracting the pneumatic cylinder 164, the undercarriage 162*a* can be positioned to align its drilling centres 170*a*, 172*a* and 174*a* with the drilling slots 150, 152, 154 or with the drilling slots 150*a*, 152*a* and 154*a*.

Similarly, the undercarriage 162*b* is slidably mounted for movement on the base 160 to align its drilling centres with either the inner or outer left hand drilling slots. Three drilling assemblies 176 (only one of which is shown) are mounted on each undercarriage. Each drill assembly 176 has a slide member 178 slidably mounted on the undercarriage and guided by guide rails 180 for movement in a direction parallel to the longitudinal slot through which its auger extends in use. A pneumatic cylinder 182 has one end secured to its associated undercarriage and has a ram 184 at its other end which is connected to the slide member 178. By activating the cylinder 182, the ram 184 can be caused to move to and fro to move the slide 178 to align the auger 186 with any one of the drilling stations of its associated slot. A support frame generally identified by the reference numeral 188 extends upwardly from the slide member 176. The support frame 188 has an upper end plate 190. A pair of guide rails 192 extend between the end plate 190 and the slide member 178. A carriage 194 is slidably mounted on the guide rails 192. An extensible pneumatic ram assembly 196 has one end connected to the slide 178 and its other end connected to the carriage 194. A drilling machine 198 is mounted on the carriage 194 for movement therewith. The auger 186 is mounted in the chuck 200 of th drilling machine so as to be rotatably driven thereby in use. By extending and retracting the pneumatic cylinder assembly 196, the carriage 194 and drilling machine 198 can be raised or lowered.

A further drill assembly 202 is provided for drilling the cavities required for the butt joint. This assembly includes a slide member 204 which is slidably mounted for movement between guide rails 206. A pneumatic ram assembly 208 is provided for moving the slide member 204 to and fro. A lower end plate 210 is pivotally mounted on the slide member 204 for movement about a pivot pin 212. A small extensible pneumatic ram assembly 214 engages the inner end of the plate 210 and is operable to cause the plate 210 to pivot about the pivot pin 212 to laterally offset the auger 186 so that it can be aligned with any one of the drilling centres 156 indicated in FIG. 5 of the drawings.

Method of Operation

The machine of the present invention is designed in order to trim and drill a log to provide the tubular cavities required in order to form the butt joint and the overlapping dovetail joints described in FIGS. 1 and 2 of the drawings. The machine is also designed to accommodate logs of different thickness and to permit drilling of logs with overlapping lap joints. Generally, the logs which are used in the construction of log buildings measure six inches, eight inches, ten inches and twelve inches in thickness and the machine of the present invention is designed to accommodate logs of four different thicknesses and to form both right and left hand locking cavities.

As shown in FIGS. 2 and 4 of the drawings, a log 14 may be introduced to the machine by sliding it along the conveyor 132 until the inner end portion thereof extends to the right hand side of the centre line 145. Thereupon the ram 112 is activated in order to drive the clamp member 118 into engagement with the side face of the log 14. In addition, the left hand cylinder 128 is activated in order to move the left hand hold down arm 126 into engagement with the upper edge of the log.

The circular saw 136 is then activated and driven into the slot 144 to cut the end of the log along the line 145 to form an end face 22.

If a butt joint is to be formed along the end face 22, the drill assembly 202 is then manipulated by activating the extensible ram assemblies 208 and 214 in order to align the auger 186 with the centre 220 (FIG. 5). The drill assembly 202 is then activated to supply power to the drilling machine to drive the auger 186 and to the extensible ram assembly 196 in order to raise the drilling auger 186 so that it passes through the opening 146 along the centre 220 and drills through the log to form a passage such as the passage 62 illustrated in FIG. 2 of the drawings. After the drilling has been completed, the auger 186 is then withdrawn by retracting the carriage 194.

Similarly, when it is intended to drill, the cavities such as the cavities 32*b* and 36*b* in the left hand logs 14, the pneumatic cylinders 182 are activated to align the augers 186 with the centres 222 and 224. The augers are then rotatably driven through the log as previously described. It will be apparent that this will provide the cavities required when the face 14*a* of the log is to form the inner face at the corner. If, on the other hand, the face 14*b* of the log is to form the inner face at the corner, it will be necessary to drill along the centre 226 and not along the centre 222. In order to drill along the centre 226, the drill assembly which powers the auger which will extend through the slot 154*b* is positioned as previously described and is operated to drill through the log.

The various drilling patterns which can be produced by the drilling machine of the present invention are illustrated in FIGS. 6 to 10 of the drawings. As shown in FIG. 6, a butt joint is provided drilling the cavities 62 and 64. The cavity 62 will be drilled when the log 14 is located in the position shown in broken lines in FIG. 5 drilling on the centre 220. The cavity 64 will be formed by locating a log on the opposite side of the datum plane 145 and drilling along the right hand centre corresponding to the centre 220. Similarly, the cavity 32*b* and the cavity 32 are formed by drilling along the centre 222 of the left hand slot 150*b* and along the corresponding centre of the right hand slot 150 respectively.

The cavity 36*b* is formed by drilling along the centre 224 of the slot 152*b* and the cavity 36 is formed by drilling along the corresponding centre of the slot 152. The cavity which is shown in broken lines is the recess 40*b* which is drilled at the time of assembly of the corner. The broken line 30*c* indicates the location of the end faces 30*a* and 30*b* in relation to the slot 36 when a tenon 24 is formed. Similarly, the broken line 28*c* indicates the position of the end faces 28*a* and 28*b* of the log 14 when a tenon 20 is formed.

The difference between the logs illustrated in FIG. 7 and that of FIG. 8 is that they are designed to form opposite corners of a structure. The cavities 32*b* and 30 are formed by drilling along the centre 226 of slot 154*b* and the corresponding centre of the slot 154 respectively.

The log illustrated in FIG. 9 differs from that of FIG. 7 in that it is designed to provide a conventional overlap joint in which the portion 25 projects beyond the tenon 24. The passages 32*b* and 36*b* are formed by drilling along the appropriate centres of the outer left hand set of slots 150*c*, 152*c*. A typical overlapping joint is illustrated in FIG. 10 which shows the drill holes 32*b* and 36*b* and the holes 40*b* and 40*a* which are drilled on site during assembly of the wall as previously described.

Various modifications of the preferred embodiment will be apparent to those skilled in the art without departing from the are 10" or 12" in width, two seal seating channels 84 may be formed in a side-by-side relationship, such being fitted with a sealing member 100.

I claim:

1. In a wall of a log structure in which a plurality of logs are interconnected by double tongue and groove joints formed at an interface between abuting edges of adjacent logs and wherein the tongues are spaced from one another by a channel and a ridge is formed between the grooves, the improvement of;

a) a seal seating groove formed in the base of said channel and extending longitudinally thereof, b) seal means in the form of an elongated length of compressible material seated in said seal seating groove and compressed between said ridge and the base of said channel to form a seal at said interface along the length of said log.

2. In a wall as claimed in claim 1, wherein the seal means is in the form of a resiliently compressible material which has an uncompressed height which is at least three times greater than its height when compressed between said ridge and base.

3. A wall as claimed in claim 2, wherein the seal means comprises a length of resiliently compressible foamed plastics material.

4. A wall as claimed in claim 1, wherein said channel is proportioned to be larger in cross-section than said ridge thereby to provide a flashing gap between each mated ridge and groove into which a flexible seal seated in said seating groove may be extruded to seal the joint formed therebetween.

5. A wall as claimed in claim 1, wherein each groove has an outer side face and each tongue has an outer side face, the outer side face of each tongue and the outer side face of each groove being formed with a caulking shoulder, the caulking shoulder of each tongue being located opposite the caulking shoulder of a groove and being spaced therefrom to form a caulking chamber therebetween when a pair of tongue and groove edges are mated, a resiliently compressible length of caulking material located in a compressed state in each caulking chamber.

6. A wall as claimed in claim 5, wherein the caulking material has a relaxed height, before it is compressed, which is at least 25% greater than the compressed height of the caulking material.

7. A wall as claimed in claim 6, wherein the caulking material is in the form of an elongated length of foamed plastics material.

8. A wall as claimed in claim 1, wherein a tertiary groove is formed in and extends longitudinally of the seal seating groove of each log and wherein a reinforcing metal rod is seated in each tertiary groove, each rod extending longitudinally of the tertiary groove in which it is mounted, said reinforcing rods cooperating with one another and serving to provide a security network of metal rode throughout the wall.

9. A wall as claimed in claim 8, wherein the reinforcing metal rods of the security network intersect one another and are secured to one another at the points where they intersect.

10. A wall assembly as claimed in claim 1 wherein a pair of first logs are arranged in an end to end relationship to form a butt joint therebetween and in which a second log is arranged in an edge to edge relationship with the first logs and bridges the butt joint and wherein locking slots are formed in each abutting end of said first logs and a locking pin is located in the locking slots which serves to lock the butting ends, a seat formed in the tongues at the edge of the second log in alignment with the locking slots, said seat penetrating the tongues to a depth which is no greater than the depth of the channel which is formed between the tongues such that the seat does not extend to the seal seating groove and does not adversely affect the seal means in use, an end of a locking pin extending into said seat, said seat cooperating with the end of the locking pin to lock the locking pin against longitudinally movement with respect to the second log.

11. In a wall construction for a building wherein first and second walls form adjoining walls which are made from first and second logs respectively, said first and second logs having end portions which are formed to provide first and second tenuous respectively which overlap to form tenon joints which connect the adjoining walls to one another, each tenon joint forming first and second interfaces, each interface being formed between oppositely disposed first and second faces of the first and second logs respectively, the improvement of;

means for securing said oppositely disposed first and second faces with respect to one another at each interface comprising;

a) a first locking slot formed in the first of said oppositely disposed faces, said first locking slot being undercut with respect to said first face in which it is formed, b) a second locking slot formed in the second of said oppositely disposed faced, said second locking slot being undercut with respect to said second face in which it is formed, d) a tie member comprising a pair of elongated lobes which are connected to one another in a side-by-side relationship, e) one lobe of said tie member being located in said first locking slot and the other lobe of said tie member being located in said second locking slot such that the tie member serves to secure said first and second faces with respect to one another.

12. A wall as claimed in claim 11, wherein said first face in which said first locking slot is formed is an end face of the first log and the second face in which the second locking slot is formed is a side face of a second tenon.

13. A wall construction as claimed in claim 11, wherein said tenons are dovetail tenons.

14. A wall construction as claimed in claim 11, wherein said tenons form a lap joint.

15. In a log of the type having first and second side edges formed with a double tongue and groove profile respectively and wherein the tongues are spaced from one another by a channel and a ridge is formed between the grooves, and wherein the channel has a depth which extends to a base face, the improvement of;

a) a seal seating groove formed in the base face of said channel and extending longitudinally thereof, said seal seating groove having a predetermined depth extending from the base face, b) resiliently compressible seal means seated in said seal seating groove, said seal means having a relaxed height which is substantially greater than the predetermined depth of said seal seating groove so as to project a substantial distance above the base face then in a relaxed condition, said seal means being arranged to be compressed by the tongue of a second log when the channel of the log is mated with a ridge of second log to form a seal within said channel.

16. A log as claimed in claim 15 wherein the relaxed height of the seal means is at least three times greater than the predetermined depth of the seal seating groove whereby the seal means may be compressed to provide a watertight seal between mated logs.

17. A log as claimed in claim 15, wherein said channel is proportioned to be larger in cross-section than said ridge thereby to provide a flashing gap between each ridge and channel when mated, into which the flexible seal is extruded to seal the joint formed therebetween.

18. A log as claimed in claim 17, wherein each groove has a bottom face and each tongue has an outer face, and wherein the grooves are wider then the tongues to ensure that the outer face of each tongue will bear against the bottom of its associated groove when mated one with the other.

19. In a log of the type having first and second side edges formed with a double tongue and groove profile respectively and wherein the tongues are spaced from one another by a channel and a ridge is formed between the grooves, and wherein the channel has a depth which extends to a base face, the improvement of a seal seating groove formed in the base face of said channel and extending longitudinally thereof, said seal seating groove having a depth extending from the base face which is less than the depth of said channel so as to permit at least 50% compression of a seal seated in said seal seating groove in use, said seal seating groove having a width which is greater than the depth of the seal seating grove, and said ridge having a flat outer face which extends laterally, said flat outer face being substantially wider than the seal seating groove such that it will extend laterally outwardly from a similar seal seating groove of a second log when the tongue and groove are mated, and wherein; each groove has an outer side face and each tongue has an outer side face, the outer side face of each tongue and the outer side face of each groove being formed with a caulking shoulder, the caulking shoulder of each tongue being located opposite the caulking shoulder of a groove and being spaced therefrom to form a caulking chamber therebetween when a pair of tongue and groove edges are mated in use.

20. In a log of the type having first and second side edges formed with a double tongue and groove profile respectively and wherein the tongues are spaced from one another by a channel and a ridge is formed between the grooves, and wherein the channel has a depth which extends to a base face, the improvement of;

a seal seating groove formed in the base face of said channel and extending longitudinally thereof, said seal seating groove having a depth extending from the base face which is less than the depth of said channel so as to permit at least 50% compression of a seal seated in said seal seating groove in use, said seal seating groove having a width which is greater than the depth of the seal seating groove, and said ridge having a flat outer face which extends laterally, said flat outer face being substantially wider than the seal seating groove such that it will extend laterally outwardly from a similar seal seating groove of a second log when the tongue and groove are mated, said channel being proportioned to be larger in cross-section than said ridge thereby to provide a flashing gap between each ridge and channel when mated into which a flexible seal seated in said seating groove may be extruded to seal the joint formed therebetween, and wherein each groove has an outer side face and each tongue has an outer side face, the outer side face of each tongue and the outer side face of each groove being formed with a caulking shoulder, the caulking shoulder of each tongue being located opposite the caulking shoulder of a groove and being spaced therefrom to form a caulking chamber therebetween when a pair of tongue and groove edges are mated.

21. In a log of the type having first and second side edges formed with a double tongue and groove profile respectively and wherein the tongues are spaced from one another by a channel and a ridge is formed between the grooves, and wherein the channel has a depth which extends to a base face, the improvement of;

a seal seating groove formed in the base face of said channel and extending longitudinally thereof, said seal seating groove having a depth extending from the base face which is less than the dept of said channel so as to permit at least 50% compression of a seal seated in said seal seating groove in use, said seal seating groove having a width which is greater than the depth of the seal seating groove, and said ridge having a flat outer face which extends laterally, said flat over face being substantially wider than the seal seating groove such that it will extend laterally outwardly from a similar seal seating groove of a second log when the tongue and groove are mated, a tertiary groove formed in and extending longitudinally of the base face of the seal seating groove to accommodate a reinforcing metal rod in a close fitting relationship whereby a security network of metal rods may be integrated into a log structure upon assembly thereof.

22. In a log of the type having first and second side edges formed with a double tongue and groove profile respectively and wherein the tongues are spaced from one another by a channel and a ridge is formed between the grooves the improvement wherein; each groove has an outer side face and each tongue has an outer side face, the outer side face of each tongue and the outer side face of each groove being formed with a laterally extending caulking shoulder, the caulking shoulder of each tongue being located opposite the laterally extending caulking shoulder of a groove and being spaced therefrom to form a caulking chamber therebetween when a pair of tongue and groove edges are mated in use.

* * * * *